United States Patent [19]

Sutera

[11] Patent Number: 4,923,091

[45] Date of Patent: May 8, 1990

[54] SELF-FILLING BOTTLED-WATER COOLER

[76] Inventor: Carl M. Sutera, 118 Richmond St., Boston, Mass. 02109

[21] Appl. No.: 321,769

[22] Filed: Mar. 10, 1989

[51] Int. Cl.[5] ..... B67D 5/08; B67D 5/62

[52] U.S. Cl. ..... 222/67; 222/146.6; 222/185; 62/389

[58] Field of Search ..... 222/64, 67, 69, 185, 222/146.1, 146.6; 62/389–391; 210/109, 128

[56] References Cited

U.S. PATENT DOCUMENTS

| | | | |
|---|---|---|---|
| 3,031,860 | 5/1962 | Middleton | 62/389 |
| 3,327,485 | 6/1967 | Ter Bush | 62/3 |
| 3,363,432 | 1/1968 | Sholtes | 62/397 |
| 3,365,904 | 1/1968 | Ross | 62/389 |
| 3,367,133 | 2/1968 | Dreis et al. | 62/390 |
| 3,468,370 | 9/1969 | Castillo | 165/66 |
| 3,495,612 | 2/1970 | Moreland II | 137/209 |
| 3,541,808 | 11/1970 | Materese | 62/397 |
| 3,572,553 | 3/1971 | Ogden | 222/67 |
| 3,688,950 | 9/1972 | Parish | 222/146 R |
| 3,731,845 | 5/1973 | Booth | 222/67 |
| 3,824,801 | 7/1974 | Laudato, Jr. | 62/201 |
| 3,845,884 | 11/1974 | Hall et al. | 222/173 |
| 3,921,855 | 11/1975 | Syverson | 222/67 |
| 4,575,615 | 3/1986 | Shigenobu et al. | 222/67 |
| 4,597,509 | 7/1986 | Pereira | 222/146.6 |
| 4,649,809 | 3/1987 | Kanezashi | 222/146.1 |
| 4,699,188 | 10/1987 | Baker et al. | 222/146.6 |
| 4,728,005 | 3/1988 | Jacobs et al. | 222/64 |
| 4,779,426 | 10/1988 | Desrosiers | 62/390 |
| 4,792,059 | 12/1988 | Kerner et al. | 222/67 |
| 4,801,375 | 1/1989 | Padilla | 222/640 |
| 4,808,346 | 2/1989 | Strenger | 222/95 |

OTHER PUBLICATIONS

"Water Conditioning & Purification; Buyers Guide" (April, 1989), p. 45 Advertisement.

*Primary Examiner*—Joseph J. Rolla
*Assistant Examiner*—Steven Rein
*Attorney, Agent, or Firm*—Weingarten, Schurgin, Gagnebin & Hayes

[57] ABSTRACT

A self-filling bottled-water cooler dispenses pure water from a transparent water bottle mounted on the top of a free-standing cabinet body. The cooler attaches to a tap-water or other continuous water source and provides a continuous supply of pure water without need to change the water bottle The free-standing cabinet body includes a water tank located within the upper portion of the cabinet body and at least one tap for dispensing water from the water tank. The water bottle is securely attached on the top of the cabinet body to the water tank such that water freely flows between the bottle and the tank. Water from the tap water or other source is purified in a reverse osmosis, carbon block or other water purifier and is routed to the water tank. An inlet valve connected to a float mechanism within the water bottle regulates the flow of purified water into the water tank. The fload mechanism closes the inlet valve only when the purified water in the water bottle is at or above a desired full level. A venting system prevents overfilling of the water bottle and a change in air pressure within the bottle whenever the level of purified water in the bottle changes.

18 Claims, 2 Drawing Sheets

SELF-FILLING BOTTLED-WATER COOLER

FIELD OF THE INVENTION

The present invention generally relates to water coolers, and more particularly to a self-filling bottled-water cooler.

BACKGROUND OF THE INVENTION

Bottled-water coolers are found in homes, offices and other locations where pure drinking water is desired. Typically, bottled-water coolers are comprised of a cooling-dispensing unit and an interchangeable glass or plastic water-filled bottle mounted in an inverted position on the top of the cooling-dispensing unit. Pure drinking water is supplied in the interchangeable bottle, cooled in the cooling-dispensing unit and dispensed through a manually operated tap on the cooling-dispensing unit. When the water is completely dispensed from the cooler, the empty bottle is manually replaced with a filled bottled by removing the empty bottle and inverting the filled bottle onto the top of the cooling-dispensing unit.

Conventional bottled-water coolers, however, have a number of inherent limitations and disadvantages. The water supply is not continuous and therefore requires the difficult and time consuming task of removing empty bottles and replacing them with heavy, filled bottles. Changing the bottles can be particularly difficult for small persons or persons of limited strength. Furthermore, water is often spilled when the bottles are changed. Therefore, the bottles of conventional water coolers cannot be changed without risk of wetting the areas around the coolers or the persons changing the bottles. Also, conventional bottled-water coolers cannot be placed in a location where water spillage could cause damage. Conventional water coolers, therefore, can be messy and wasteful.

As the water supply in conventional bottled-water coolers is not continuous, conventional bottled-water coolers also cannot be used during the times they are empty. Users must wait until the bottles are changed. Frequently, this means that users of conventional water coolers must wait until persons can be found to change the bottles of the coolers or until new shipments of filled bottles arrive for the coolers.

Bottle-less water coolers overcome some of the disadvantages of conventional bottled-water coolers. In bottle-less water coolers, water is continuously pumped or otherwise supplied from a pure water source into a cooling-dispensing unit similar to the cooling-dispensing unit of a conventional bottled-water cooler. Because the water is pumped from a continuous source and a bottle is not needed, bottle-less water coolers, as their name implies, do not employ bottles to store the pure water.

Because bottle-less water coolers do not employ filled water bottles, they also have a number of inherent disadvantages. People associate water coolers with conventional bottled-water coolers. When people think of water coolers, they think of conventional bottled-water coolers. It is the water bottle on the top of the cooler that most indicates to the public that the unit is a water cooler. Therefore, a bottle-less water cooler is less easily recognized by the public as a water cooler.

Bottle-less water coolers are also less psychologically attractive to the public than bottled-water coolers. The public associates the quality of water dispensed by a conventional bottled-water cooler with the pure, crystal-clear look of the water in the bottle above the cooling-dispensing unit. The pure, crystal-clear appearance of the water in the bottle reminds the user that the cooler only dispenses pure water. A water cooler without a bottle displaying pure water, however, appears to dispense little more than tap water and does not provide the psychological assurance provided by conventional bottled-water coolers that pure water, rather than tap water, is being dispensed. Therefore, bottle-less water coolers are less popular with the public than bottled-water coolers.

SUMMARY OF THE INVENTION

To overcome the inherent disadvantages and limitations, and yet to combine the advantages of conventional bottled-water coolers and bottle-less water coolers, a self-filling bottled-water cooler is provided.

The self-filling bottled-water cooler includes a free-standing cabinet body having a water tank within the upper portion of the cabinet body. A transparent water bottle is securely attached in an inverted position on the top of the cabinet body to the water tank such that water freely flows between the bottle and the water tank.

Water is provided to the cooler from a tap-water or other continuous water source. The water is purified by a reverse osmosis, carbon block or other Purifier and is then transferred to an inlet valve which regulates the flow of water into the water tank. The inlet valve is biased to an open position but can be closed to stop the flow of purified water into the water tank.

The self-filling bottled-water cooler also includes a float mechanism disposed within the water bottle. The float mechanism is connected to the inlet valve and closes the valve when the level of purified water in the bottle rises to a desired full level.

The purified water passes through the inlet valve and fills the water tank and the water bottle. When the purified water level reaches the desired full level, buoyancy causes the float mechanism to close the inlet valve to stop the flow of purified water into the water tank and the bottle.

The purified water is dispensed from the water tank of the cooler through one or more taps connected to the water tank and mounted on the cabinet body. Cooling and heating systems can be included in the cooler to vary the temperature of the pure water dispensed through the taps.

The self-filling bottled-water cooler also includes a venting system which prevents overfilling of the water bottle and vents the air space within the water bottle above the purified water level to prevent a change in air pressure in the air space. The venting systems includes a check valve and a hydrophobic bacteria filter to prevent contaminants from entering the water supply through the venting system.

The present invention provides a continuous supply of clear, pure water. Water cooler service is not interrupted and the bottle of the cooler is not changed. Therefore, a time-consuming, potentially messy and wasteful operation is not needed to maintain the water supply. Because the present invention resembles a conventional water cooler, it is easily recognized as a water cooler and possesses the psychological benefits conventional bottled-water coolers have over bottle-less water coolers.

BRIEF DESCRIPTION OF THE DRAWINGS

A more complete understanding of the present invention and its attendant advantages and features thereof will be more readily understood by reference to the following detailed description when considered in conjunction with the accompanying drawings, wherein.

DETAILED DESCRIPTION OF THE PREFERRED EMBODIMENTS

Figure 1:
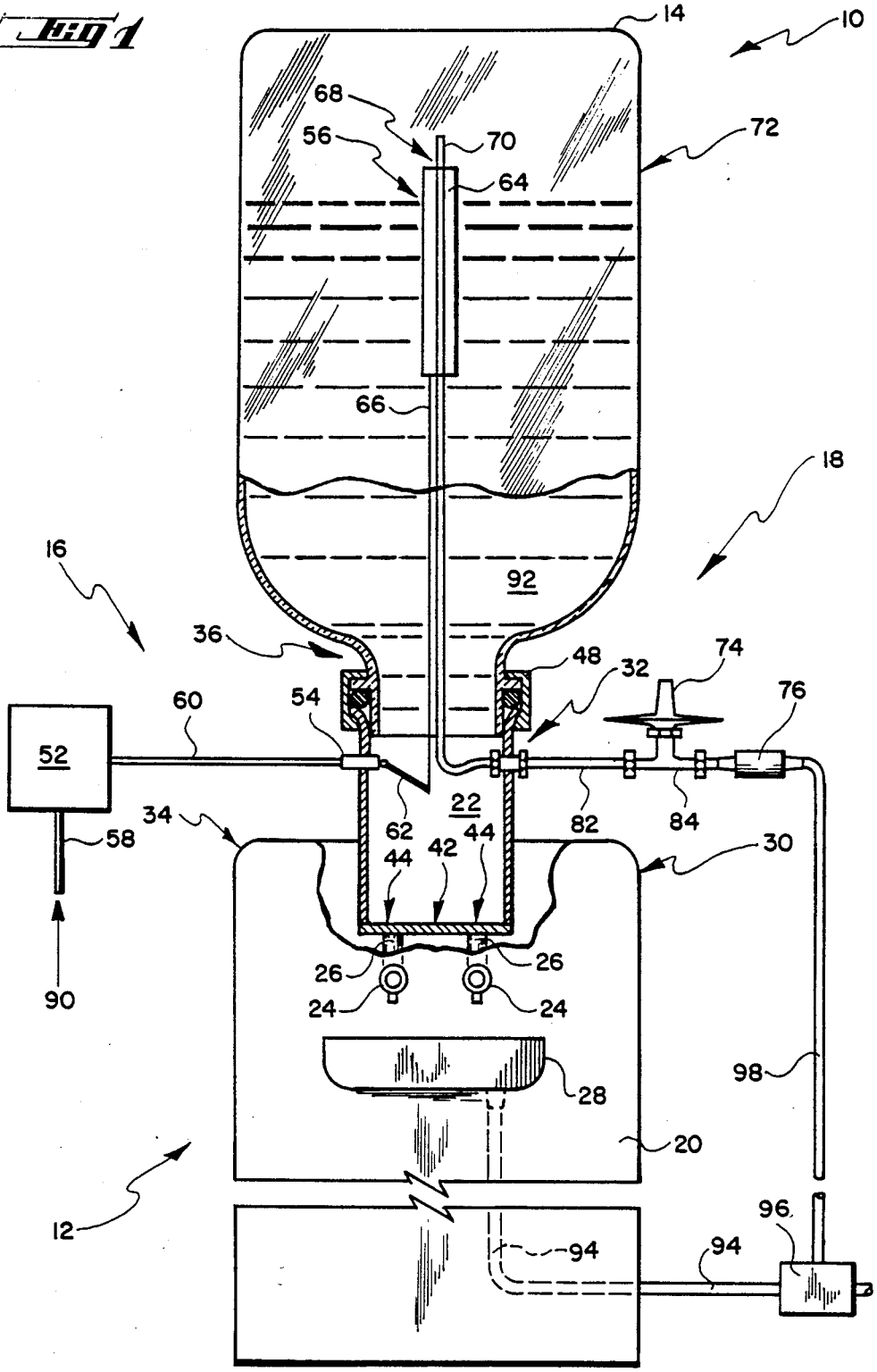
FIG. 1 is a partial cross-section view of a self-filling bottled-water cooler according to the present invention.

Referring now to the drawings wherein like reference numerals designate corresponding or similar elements throughout the several views, an exemplary self-filling bottled-water cooler 10 according to the present invention is depicted in FIG. 1. The self-filling bottled-water cooler 10 includes a dispensing system 12, a water bottle 14, a water inlet system 16 and a venting system 18.

The dispensing system 12 includes a free-standing cabinet body 20, a water tank 22 located in the upper portion 30 of the cabinet body, at least one tap 24 mounted on the front of the cabinet body 20 and plumbing connections 26 from the water tank 22 to the taps 24 to permit water to flow from the water tank through the taps when the taps are opened. The dispensing system can also include a heating and/or cooling system (not shown) to vary the temperature of water dispensed through the taps. For example, a heating system can be included so that one tap dispenses hot water for coffee, tea or soup, and a cooling system can be included so that another tap dispenses cold water for cold drinks. Such heating and cooling systems are known in the industry and therefore are not described here.

The cabinet body 20 can also include a spill tray 28 mounted under the taps 24 to catch water spilled from the taps. Such spill trays are also known in the industry. A spill drain line 44 can be included in the cabinet body to drain spilled water from the spill tray 28 to a drain pump 96.

The cabinet body 20 is self-standing and must be configured to stably support the water bottle 14 filled with water. The cabinet body can be formed of sheet metal, plastic or other rigid materials.

The water tank 22 is located within the upper portion 30 of the cabinet body 20 such that an upper section 32 of the water tank extends upward beyond the top surface 34 of the cabinet body to mate with the neck 36 of the water bottle 14. Alternatively, the water tank 22 can be located completely within the upper Portion 30 of the cabinet body 20 such that the neck 36 of the water bottle 14 projects downward into the upper portion 30 of the cabinet body to mate with the upper section 32 of the water tank. The water tank 22 can be made of stainless steel or any other sturdy material non-reactive with water and has a circular horizontal cross section. The upper edge 38 of the water tank is flared to accommodate an O-ring seal 40. The bottom surface 42 of the tank has at least one outlet 44 to allow water in the tank to flow through the plumbing connections 26 to the taps 24 for dispensing.

Figure 2:
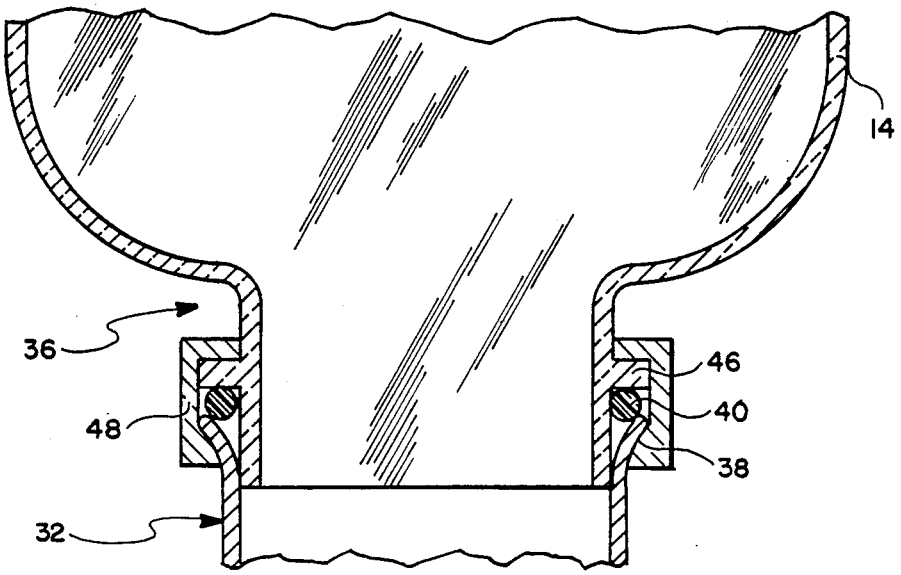
FIG. 2 is a cross-section view of the self-filling bottled-water cooler of FIG. 1 showing attachment of the bottle to the upper section of the water tank.

The water bottle 14 can be made of glass, plastic or any other transparent rigid material and is securely attached in an inverted position to the upper section 32 of the water tank of the cabinet body 20. As can best be seen in FIG. 2, the water bottle 14 is formed with a straight neck 36 having an annular flange 46. The outside diameter of the straight neck 36 is selected to be slightly smaller than the inside diameter of the upper section 32 of the water tank such that its neck 36 snugly slides into the inside of the upper section 32 of the water tank 22. As can be seen in the figure, the flared upper edge 38 of the water tank cooperates with the annular flange 46 formed on the neck of the water bottle and an O-ring seal 40 placed between the flared upper edge 38 and the annular flange 46 to seal the joint between the bottle 14 and the water tank 22. Clamps 48 engage the annular flange 46 and the flared upper edge 38 to secure the bottle onto the water tank 22 and to provide additional pressure on the O-ring seal 40 to seal the joint.

The water inlet system 16, which supplies purified water to the interior of the water bottle, includes water inlet lines 58 and 60, a reverse osmosis, carbon block or other water purifier 52, an inlet valve 54 and a float mechanism 56. A first water inlet line 58 connects to a tap-water or other continuous water source (not shown) to supply water 90 to the water purifier 52, which purifies the water. The water purifier 52 can purify the water to greater than 99% purity, which is greater than the purity of bottled water supplied for conventional bottled water coolers. A second water inlet line 60 connects the water purifier 52 to the inlet valve 54 to supply purified water to the water tank 22 of the dispensing system 12. The inlet valve 54 is mounted on the water tank 22 and regulates the flow of purified water into the water tank. The inlet valve 54 is biased in an open position to normally allow the purified water to enter the water tank 22. A lever 62 on the inlet valve 54 moves upward in a vertical arc to close the valve to control the flow of purified water into the water tank 22.

The float mechanism 56 includes a tubular float 64 and a thin wire, filament or other linkage 66. The float 64 is made of polycarbonate and has an axial hole 68 through its center. The float 64 is slidably disposed on an overflow tube 70 which extends vertically in the bottle 14 from the water tank 22 to the upper portion 72 of the bottle. The overflow tube 70 passes through the axial hole 68 in the float such that the float 64 is free to slide vertically on the tube 70. The wire, filament or other linkage 66 connects the float to the lever 62 of the inlet valve 54 to control the position of the lever and therefore to regulate the valve.

Figure 3:
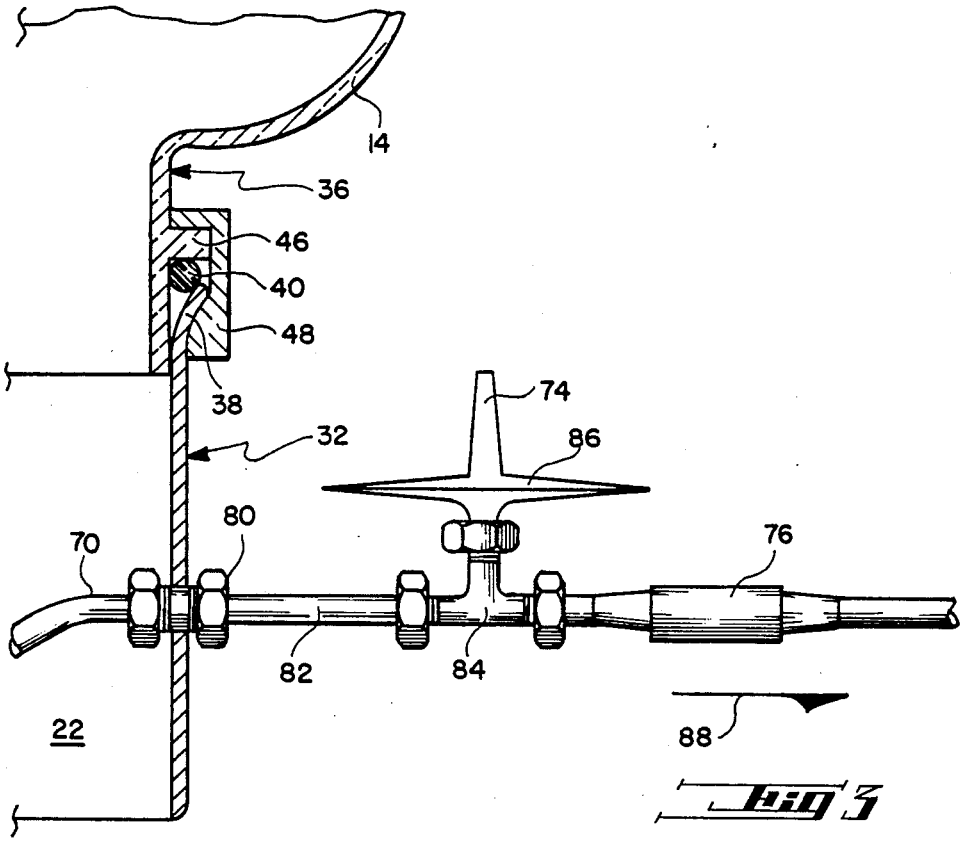
FIG. 3 is a partial cross-sectional view of the self-filling bottled-water cooler of FIG. 1 showing a portion of the venting system.

The venting system 18 includes the overflow tube 70, an air vent 74 having a hydrophobic bacteria filter, a check valve 76, a drain pump 96 and drain line plumbing 80, 82, 84, and 98. The overflow tube 70 is made of plastic, stainless steel or any other rigid material non-reactive with water and is rigidly attached to the water tank 22 by conventional plumbing fixtures 80 such that the overflow tube 70 provides a passage from the upper portion 72 of the water bottle down through the bottle 14 and out through the water tank 22. As can be seen in FIG. 3, a drain line 82 and a "T" fixture 84 connect the overflow tube 70 at the plumbing fixtures 80 on the water tank 22 to the air vent 74 and check valve 76. A drain line 98 connects the check valve 76 to the drain pump 96. The drain pump 96 pumps spilled water collected by the spill tray 28 and overflow water collected by the venting system to a drain destination.

The air vent 74 includes a hydrophobic bacteria filter in a housing 86 to prevent bacteria and other contaminants from entering the water supply through the air vent. Typically, a 0.22 microfilter is used. The check valve 76 only permits fluid flow in the direction of the arrow 88 and therefore also prevents contaminants from backflowing through the venting system into the water supply.

The venting system 18 acts as an emergency overflow drain to prevent the water bottle 14 from overfilling. The venting system 18 also provides an air vent to the upper portion 72 of the water bottle above the water level in the bottle. Venting of the bottle above the water level is necessary to prevent a change in air pressure within the bottle when water is added to the bottle or dispensed through the taps 24. Without venting of the bottle, air pressure would build in the bottle as water is added to the bottle until the pressure is great enough to prevent additional water from entering the bottle. Therefore, without venting, the bottle would never fill. Conversely, without venting of the bottle, air pressure would drop in the bottle as water was dispensed through the taps 24 until the drop was great enough to prohibit flow of water through the taps. Therefore, without venting, the flow of water through the taps would be inhibited.

As can be seen from the figures, water 90 enters the first inlet line 58 of the cooler and is purified in the water purifier 52. The purified water 92 passes through the second inlet line 60 and the inlet valve 54 and fills the water tank 22 and the water bottle 14 until the water 92 in the bottle reaches the desired full level, raises the float 64 and closes the inlet valve 54. As the water 92 fills the water bottle 14, air exits the bottle through the venting system 18 to keep the air pressure in the bottle constant. The water level then remains constant until a user dispenses water from the cooler.

When a tap 24 is opened, water is dispensed from the water bottle 14 and the water tank 22 through the tap. This causes the water level in the bottle to drop which in turn causes the float 64 to lower and therefore to open the inlet valve 54 once again to allow more purified water 92 to enter the water tank 22 and water bottle 14 to restore the water level in the bottle to its original place. As the water level in the bottle drops, air enters the bottle through the venting system 18 to keep the air pressure in the bottle constant.

If the inlet valve 54 malfunctions by remaining in the open position and the water level within the bottle rises above the normal full level of the bottle, purified water 92 flows into the overflow tube 70 and passes out of the cooler without causing water pressure to build in the bottle.

A variety of modifications and variations of the present invention are possible in light of the above teachings. It therefore should be understood that the present invention may be practiced otherwise than as specifically described above and that the scope of the present invention is only defined by the following claims.

I claim:

1. A self-filling bottled-water cooler, comprising:

a cabinet body;

a water tank disposed within the top portion of the cabinet body;

at least one tap disposed on the cabinet body and connected to the water tank for dispensing pure water from the water tank;

a water bottle mounted on top of the cabinet body to the water tank such that water freely flows between the water bottle and the water tank;

a water purifier fluidically connected to the water tank and fluidically connectable to an external water source;

an inlet valve fluidically connected to the water purifier and the water tank and regulating the flow of pure water form the water purifier into the water tank;

a water level controlling means connected to the inlet valve to allow pure water to flow into the water tank to fill the water bottle when pure water within the water bottle is below a desired full level and to close the inlet valve when the pure water is at or above the desired full level; and, a venting system at least part of which is disposed within the water bottle for preventing a change in air pressure within the water bottle when the level of pure water in the bottle changes.

2. The cooler of claim 1, wherein the venting system includes a vertically upstanding tube disposed within the water tank and the water bottle and having an open end above the desired full level of the water bottle.

3. The cooler of claim 2, wherein the venting system includes a hydrophobic bacteria filter for preventing contaminants from entering the water bottle through the venting system.

4. The cooler of claim 3, wherein the venting system prevents overfilling of the water bottle and includes a check valve to prevent contaminants from entering the water bottle through the venting system.

5. The cooler of claim 4, wherein the venting system includes a drain pump to pump overflow water collected by the venting system to a drain destination.

6. The cooler of claim 1, wherein the water bottle includes a neck having an annular flange and an O-ring seal confronting the flange, wherein the water tank includes an upper open section having a flared edge, and wherein the neck of the water bottle fits within the upper open section of the water bottle and the annular flange on the neck of the water bottle cooperates with the flared edge of the water tank and the O-ring seal to seal the water bottle to the water tank.

7. The cooler of claim 6 wherein the cooler includes at least one clamp engaging the annular flange on the neck of the water bottle and the flared edge of the water tank to securely clamp the water bottle to the water tank.

8. The cooler of claim 1, wherein the inlet valve includes a manually operated lever for regulating the flow of pure water from the water purifier into the water tank, and wherein the water level controlling means includes a float disposed within the water bottle and a linkage connecting the float to the manually operated lever to allow pure water to flow into the water tank to fill the water bottle when pure water within the water bottle is below the desired full level and to close the inlet valve when the pure water is at or above the desired full level.

9. A self-filling bottled-water cooler, comprising:

a cabinet body;

a water tank disposed within the top portion of the cabinet body; and including an upper open section having a flared edge;

at least one tap disposed on the cabinet body and connected to the water tank for dispensing pure water from the water tank;

a water bottle including a neck having an annular flange and an O-ring seal confronting the annular flange, wherein the water bottle is mounted on top of the cabinet body such that water freely flows between the water bottle and the water tank, and wherein the neck of the water bottle fits within the upper open section of the water tank and the annular flange on the neck of the water bottle cooperates with the flared edge of the water tank and the O-ring seal to seal the water bottle to the water tank;

at least one clamp engaging the annular flange on the neck of the water bottle and the flared edge of the water tank to securely clamp the water bottle to the water tank;

a water purifier fluidically connected to the water tank and fluidically connectable to an external water source;

an inlet valve fluidically connected to the water purifier and the water tank and regulating the flow of pure water from the water purifier into the water tank, wherein the inlet valve includes a manually-operated lever for regulating the flow of pure water from the water purifier into the water tank;

a float disposed within the water bottle and connected to the manually operated lever to allow pure water to flow into the water tank to fill the water bottle when pure water within the water bottle is below a desired full level and for closing the inlet valve when the pure water is at or above the desired full level; and a venting system for preventing overfilling of the water bottle and for preventing a change in air pressure within the water bottle when the level of pure water in the bottle changes, the venting system including:

a vertically upstanding tube disposed within the water tank and the water bottle and having an open end above the desired full level of the water bottle;

a hydrophobic bacteria filter for preventing contaminants from entering the water bottle through the venting system; and a check valve to prevent contaminants from entering the water bottle through the venting system.

10. A self-filling bottled-water cooler, comprising:

a cabinet body;

a water tank disposed within the top portion of the cabinet body;

at least one tap disposed on the cabinet body and connected to the water tank for dispensing pure water from the water tank;

a water bottle mounted on top of the cabinet body to the water tank such that water can freely flow between the water bottle and the water tank;

an inlet valve fluidically connected to the water tank to regulate the flow of pure water from an external pure water source into the water tank;

a water level controlling means connected to the inlet valve to allow pure water to flow into the water tank to fill the water bottle when pure water within the water bottle is below a desired full level and to close the inlet valve when the pure water is at or above the desired full level; and, a venting system at least part of which is disposed within the water bottle for preventing a change in air pressure within the water bottle when the level of pure water in the bottle changes.

11. The cooler of claim 10, wherein the venting system includes a vertically upstanding tube disposed within the water tank and the water bottle and having an open end above the desired full level of the water bottle.

12. The cooler of claim 11, wherein the venting system includes a hydrophobic bacteria filter for preventing contaminants from entering the water bottle through the venting system.

13. The cooler of claim 12, wherein the venting system prevents overfilling of the water bottle and includes a check valve to prevent contaminants from entering the water bottle through the venting system.

14. The cooler of claim 13, wherein the venting system includes a drain pump to pump overflow water collected by the venting system to a drain destination.

15. The cooler of claim 10, wherein the water bottle includes a neck having an annular flange and an O-ring seal confronting the flange, wherein the water tank includes an upper open section having a flared edge, and wherein the neck of the water bottle fits within the upper open section of the water bottle and the annular flange on the neck of the water bottle cooperates with the flared edge of the water tank and the O-ring seal to seal the water bottle to the water tank.

16. The cooler of claim 15 wherein the cooler includes at least one clamp engaging the annular flange on the neck of the water bottle and the flared edge of the water tank to securely clamp the water bottle to the water tank.

17. The cooler of claim 10, wherein the inlet valve includes a manually operated lever for regulating the flow of pure water from the pure water source into the water tank, and wherein the water level controlling means includes a float disposed within the water bottle and a linkage connecting the float to the manually operated lever to allow pure water to flow into the water tank to fill the water bottle when pure water within the water bottle is below the desired full level and to close the inlet valve when the pure water is at or above the desired full level.

18. A self-filling bottled-water cooler, comprising:

a cabinet body;

a water tank disposed within the top portion of the cabinet body; and including an upper open section having a flared edge;

at least one tap disposed on the cabinet body and connected to the water tank for dispensing pure water from the water tank;

a water bottle including a neck having an annular flange and an O-ring seal confronting the annular flange, wherein the water bottle is mounted on top of the cabinet body such that water can freely flow between the water bottle and the water tank, and wherein the neck of the water bottle fits within the upper open section of the water tank and the annular flange on the neck of the water bottle cooperates with the flared edge of the water tank and the O-ring seal to seal the water bottle to the water tank;

at least one clamp engaging the annular flange on the neck of the water bottle and the flared edge of the water tank to securely clamp the water bottle to the water tank;

an inlet valve fluidically connected to the water tank to regulate the flow of pure water from an external pure water source into the water tank, wherein the inlet valve includes a manually-operated lever for regulating the flow of pure water from the pure water source into the water tank;

a float disposed within the water bottle and connected to the manually operated lever to allow pure water to flow into the water tank to fill the water bottle when pure water within the water bottle is below a desired full level and for closing the inlet valve when the pure water is at or above the desired full level; and a venting system for preventing overfilling of the water bottle and for preventing a change in air pressure within the water bottle when the level of pure water in the bottle changes, the venting system including:

a vertically upstanding tube disposed within the water tank and the water bottle and having an open end above the desired full level of the water bottle;

a hydrophobic bacteria filter for preventing contaminants from entering the water bottle through the venting system; and a check valve to prevent contaminants from entering the water bottle through the venting system.

* * * * *